United States Patent [19]

Portell-Vila

[11] Patent Number: 4,718,370

[45] Date of Patent: Jan. 12, 1988

[54] MAST RAISING MECHANISM FOR SAILBOAT

[76] Inventor: Alejandro Portell-Vila, 1990 W. 56 St., No. 1110, Hialeah, Fla. 33012

[21] Appl. No.: 948,071

[22] Filed: Dec. 31, 1986

[51] Int. Cl.[4] ..... B63B 15/00

[52] U.S. Cl. ..... 114/91; 254/326

[58] Field of Search ..... 114/39, 39.2, 89–91; 212/262; 254/325, 327, 334, 326

[56] References Cited

U.S. PATENT DOCUMENTS 2,892,555 6/1959 Hoober ..... 254/326 X

FOREIGN PATENT DOCUMENTS 3327227 2/1984 Fed. Rep. of Germany ..... 114/90

*Primary Examiner*—Sherman D. Basinger

*Attorney, Agent, or Firm*—John Cyril Malloy

[57] ABSTRACT

The mast raising mechanism operates on a hinged mast and includes an elongated base section that is removably attached to the lower mast section that is uprightly affixed in the boat. An elongated extender section is telescopically extended from the base section and is locked in place. A pulley is mounted at the top of the extender section. A line, attached to the mid region of the mast, passes over the top of the pulley and the end of the line is acted on by a crank which is on the base section. Due to the height of the base section plus extender section, and due to the angle of the line, a person can easily wind up the line and raise the mast.

4 Claims, 7 Drawing Figures

MAST RAISING MECHANISM FOR SAILBOAT

BACKGROUND OF THE INVENTION

The present invention relates to a mechanism for raising a mast on a sailboat.

In some sailboats, the mast is hinged and is adapted to lay substantially horizontal against the boom when the boat is not in use. The mast is divided into a principal mast section and a lower mast section. The lower mast section is set into the boat and is affixed in an upright position. The principal mast section is hinged to the lower mast section. In order to raise the mast, a person would normally "walk" the mast from the stern of the boat to the bow thereby lifting the mast to its operable vertical position. Then, a pin is inserted that locks the principal mast and lower mastsections together as a vertically aligned mast assembly. This procedure of lifting or raising the mast is difficult and awkward for many people.

OBJECTS OF THE INVENTION

It is an object of the present invention to provide a mast raising mechanism that raises the mast by action of a cranking mechanism or winch.

It is another object of the present invention to provide a mast raising mechanism that is removably attached to the mast, and therefore, stowable on the boat.

It is another object of the present invention to provide a collapsible mast raising mechanism, and therefore, compact mechanism.

SUMMARY OF THE INVENTION

The mast raising mechanism includes an elongated base section that is removably attached to the lower mast section. The lower mast section is uprightly affixed in the boat. An elongated extender section telescopes from the base section and is locked in place by a flip lock which mates in a slot in the base section. A pulley is mounted at the top of the extender section. A line is attached to the mid region of the mast when the mast is in the substantially horizontal position generally adjacent to the boom. The line passes over the top of the pulley and the end of the line is acted on by a crank or winch that is mounted on the upper region of the base section. Due to the height of the base section plus extender section, and due to the angle of the line, a person can easily wind up the line and raise the mast.

It will be recalled that the mast is hinged to the lower mast section. The lower end of the base section fits into a cup attached to the lower mast section and a finger extends from a proximal location on the base section and into a slot in the lower mast section. The finger hooks onto the mast section by resting against an adjacent side wall of that section. After the mast is raised, the extender section is unlocked, is collapsed into the base section, the line attached to the mast is detached, the base section is lifted from the lower most section by withdrawing the finger from the slot and withdrawing the lower most end of the base section from the cup holder. The compact mast raising mechanism can then be stowed away on the boat.

BRIEF DESCRIPTIONS OF THE DRAWINGS

The subject matter which is regarded as the invention is particularly pointed out and distinctly claimed in the concluding portion of the specifications. The invention, however, together with further objects and advantages thereof, may best be understood by reference to the following description taken in conjunction with the accompanying drawings in which:

DETAILED DESCRIPTION OF THE INVENTION

The present invention relates to a mast raising mechanism for raising a hinged mast on a sailboat.

Figure 1:
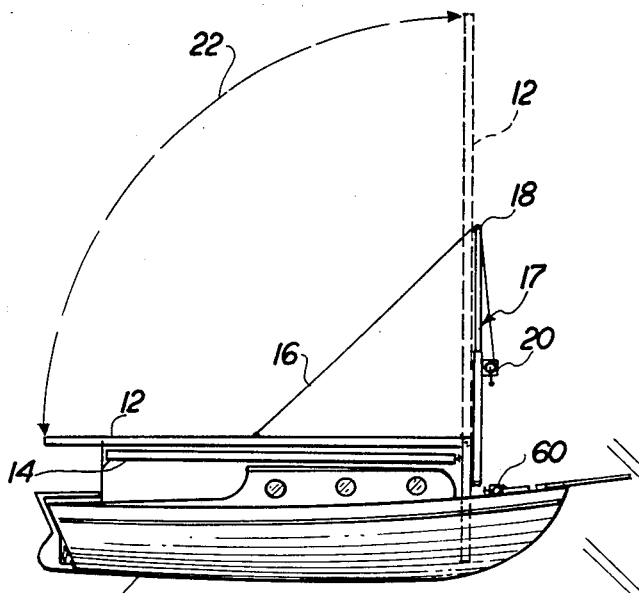
FIG. 1 illustrates a side view of a sailboat having the mast raising mechanism fully extended and the principal portion of the mast horizontally adjacent the boom before the mast is raised by the mast raising mechanism.

FIG. 1 illustrates a side view of sailboat 10 having hinged mast 12 in a substantially horizontal position adjacent boom 14. Line 16 is attached somewhere in the mid section of mast 12, runs over pulley 18 at the top end of a mast raising mechanism 17 and runs to a crank mechanism or winch 20 attached to the base section of the mast raising mechanism. The dash line shows the raised position of mast 12 and shows arc 22 describing the movement of the tip of the mast.

Figure 2:
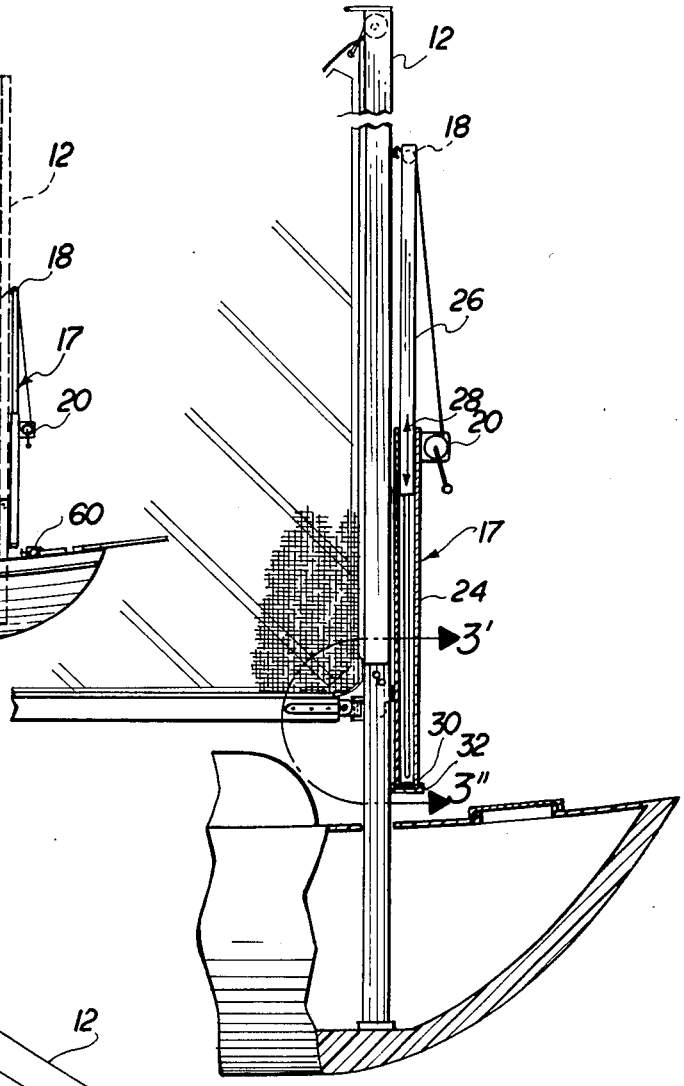
FIG. 2 is a partial, cross-sectional view of the bow of the boat and a more detailed cross-sectional view of the mast raising mechanism with the mast raised.

Mast raising mechanism 17 is shown in detail in FIG. 2. In that figure, mast 12 has been raised.

Mast raising mechanism 17 includes an elongated base section 24 and extender section 26. Extender section 26 telescopically slides as shown by double headed arrow 28 into and out of elongated base section 24. Pulley 18 is shown at the top of extender section 26. Crank 20 is affixed to the top region of base section 24. The lower most end 30 of base section 24 is set into a cup 32. This is best seen from the cross-sectional view of FIG. 3. Additionally, the lower mast section 34 includes slot 36 into which fits finger 38 that extends from base section 24. A groove or slot 40 in base section 24 provides a track for guiding extender section 26. In this embodiment, section 26 is movably disposed in the interior of section 24. By utilizing finger 38 and cup 32, the mast raising mechanism is removably attached to lower mast section 34. The mechanism is removed by vertically raising the base section out of cup 34 such that finger 38 is no longer in contact with the adjacent side wall of lower mast section 34.

Figure 3:
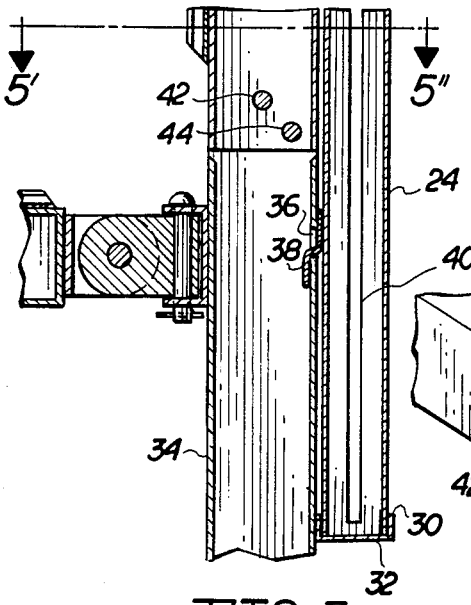
FIG. 3 is a detailed cross-sectional view of the mast raising section along the area designated by the broken lines extending from curved line 3—3 in FIG. 2.

Also shown in FIG. 3 is pivot pin 42 and locking pin 44. Locking pin 44 extends through two pair of horizontally aligned holes in the lower mast section and the principal mast section when the mast is vertically raised. Hinge pin 42 allows mast section 12 to pivot thereabout with respect to lower mast section 34.

Figure 4:
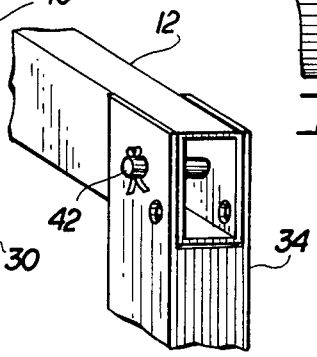
FIG. 4 is a detailed view of the hinge between the principal mast section and the lower mast section.

As shown in FIG. 4, hinge pin 42 provides a pivot point between principal mast section 12 and lower mast section 34.

Figure 5:
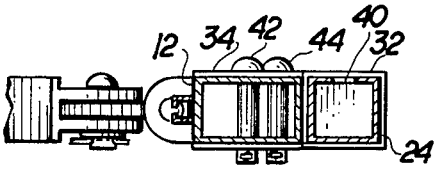
FIG. 5 is a cross-sectional top view from the perspective of section lines 5—5 in FIG. 3.

FIG. 5 shows a cross-sectional top view of the mast raising assembly and the raised mast 12. As shown, mast section 12 fits within lower mast section 34 and is locked in place by hinge pin 42 and locking pin 44. Cup 32 holds the lower end of base section 24 and a groove 40 provides a guiding means for extender section 26.

Figure 6:
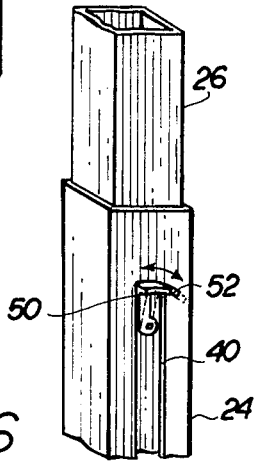
FIG. 6 illustrates a partial, perspective view of the base section, the extender section and the locking mechanism; and, FIG. 7 illustrates one possible stowage location for the compact, mast raising mechanism on the boat.

FIG. 6 shows a flip lever lock 50 that extends outward from extender section 26 through slot 40. When extender section 26 is fully extended, locking lever 50 is movable into slot 52 that is located in the upper region of section 24 thereby preventing extender section 26 from falling back into the base section, whereby an assembly to raise the mast is maintained in the fully extended vertical position.

Figure 7:
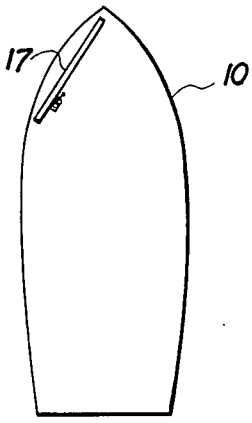

FIG. 7 shows mast raising mechanism 17 stowed in the bow portion of boat 10.

The claims appended hereto are meant to cover modifications and changes of the invention within the scope and spirit of the invention. For example, cranking means 20 need not be affixed to the base section 24, but may be replaced by cranking means or winch 60 shown in FIG. 1. In this case, pulley 18 is simply a pulling force directing means mounted at the top of the extender section 26. The force directing means may simply be a bar over which rides the line. Of course, pulley 18 directs the pulling force at an angle as is necessary to raise mast 12. The removable mounting feature utilizing as cup 32, slot 36 and finger 38 may be replaced by a strap or clamp extending around the periphery of the base section and the lower mast section 34. Similarly, the locking mechanism shown by locking lever 50 in slot 52 in FIG. 6 may be replaced by other known mechanisms. Also, the extender section can be telescopically mated with the base section in many ways other than described above with respect to the preferred embodiment.

What I claim is:

1. A mast raising mechanism for raising a mast that is hinged to a lower mast section uprightly affixed in a sailboat, said mast raising mechanism comprising:

(a) an elongated base section having means for removably mounting said elongated base section to said lower mast section in a vertical position, (b) said lower mast section including a cup-like holder adapted to receive the lower end of said elongated base section and including a slot therein, (c) said elongated base section having a finger adapted to fit into said slot and hook against an adjacent side wall of said lower mast section when said lower end of said elongated base section is set in said cup-like holder, (d) an extender section telescopically movable with respect to said elongated base section and having a means for locking said extender section to said elongated base section when said extender section is fully extended, and (e) means for pulling said mast from a substantially horizontal position to a substantially vertical position via a pulling force directing means mounted at the top of said extender section.

2. A mast raising mechanism as claimed in claim 1 wherein said pulling force directing means is a pulley mounted at the top of said extender section.

3. A mast raising mechanism as claimed in claim 2 wherein a line is attached to said mast at a mid section thereof, said line is run through said pulley to said means for pulling said mast.

4. A mast raising means as claimed in claim 3 wherein said means for pulling is a crank mechanism mounted on said elongated base section.

* * * * *